United States Patent [19]

Cook

[11] Patent Number: 4,513,914

[45] Date of Patent: Apr. 30, 1985

[54] INSERTS FOR SQUEEZE BOTTLES

[75] Inventor: Norman Cook, Wirral, England

[73] Assignee: Lever Brothers Company, New York, N.Y.

[21] Appl. No.: 435,830

[22] Filed: Oct. 21, 1982

[30] Foreign Application Priority Data

Oct. 30, 1981 [GB] United Kingdom ..... 8132795

[51] Int. Cl.[3] ..... B05B 1/28

[52] U.S. Cl. ..... 239/121; 239/327; 239/601

[58] Field of Search ..... 222/566, 567, 575; 239/120, 121, 327, 601

[56] References Cited

U.S. PATENT DOCUMENTS

| | | | |
|---|---|---|---|
| 2,723,881 | 11/1955 | Tupper | 239/327 |
| 3,220,657 | 11/1965 | Nyden | 239/327 |
| 3,258,208 | 6/1966 | Greenbaum, II | 222/566 |
| 4,378,088 | 3/1983 | Ewing | 239/327 |

FOREIGN PATENT DOCUMENTS

| | | | |
|---|---|---|---|
| 1579131 | 11/1980 | United Kingdom | 239/327 |

*Primary Examiner*—Jeffrey V. Nase

*Attorney, Agent, or Firm*—Lynne Darcy; James J. Farrell

[57] ABSTRACT

Plug inserts for squeeze bottles are provided with a dished diaphragm to ensure rapid drain-back of liquid which is expelled from the bottle but which is surplus to requirements. The orifice is designed to supply an angled jet of liquid and to give a visual indication to the user of the angle at which the jet will emerge.

1 Claim, 9 Drawing Figures

INSERTS FOR SQUEEZE BOTTLES

This invention relates to inserts for squeeze bottles containing liquid.

Inserts generally known in the packaging art as plug inserts formed with a nozzle designed to fit into the neck of a squeeze bottle are known in the art. One such plug insert is shown and described in British Patent Specification No. 1579131 (Metal Box Limited). This plug insert is designed so that it is not ejected from the squeeze bottle along with the liquid when the bottle is squeezed, and it is also designed so that if liquid is retained near the nozzle then it drains back into the bottle and not over the exterior.

These plug inserts are quite satisfactory, but are designed so that the nozzle is placed centrally, and the jet of liquid expressed from the bottle is delivered axially.

We have found a need for a plug insert incorporating the drain back feature of the previous inserts but in which the nozzle is formed so that the jet of liquid is delivered directionally, that is to say in a direction other than axially of the insert. However we have felt it desirable to so design the insert that the user can see from the appearance of the insert itself in which direction the jet of liquid will emerge on squeezing and thus avoid accidental spillage.

Accordingly, the invention provides an insert for a squeeze bottle comprising a tubular plug portion engageable in a liquid-tight manner with the interior of the bottle neck and a re-entrant diaphragm rooted on the bore of the plug, characterised in that (a) the diaphragm is formed with a nozzle angled to direct a jet of liquid at an angle of at least 20° to the axis of the plug and (b) the diaphragm is formed with a visual indication of the direction in which the jet of liquid is to be directed.

The invention is particularly applicable to bottles formed of resilient plastics material and filled with liquids intended for use in the home, such as detergent liquids, liquid bleaches and sauces.

The inserts are so designed that they push into the neck of a plastics squeeze bottle, and we have not found it necessary to adopt the measures proposed in Patent No. 1579131 to avoid difficulties associated with leakage.

The inserts in accordance with the invention may be used in combination with an external screw-threaded cap for the bottle with, if desired, a sealing or venting wad.

Normally the inserts will be injection moulded in low-density polyethylene.

Figure 1:
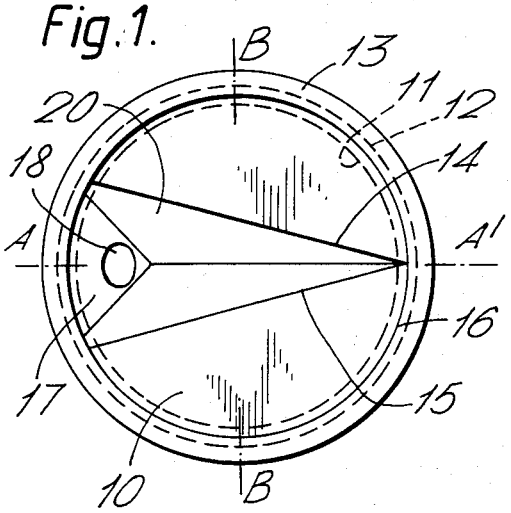
Figure 2:
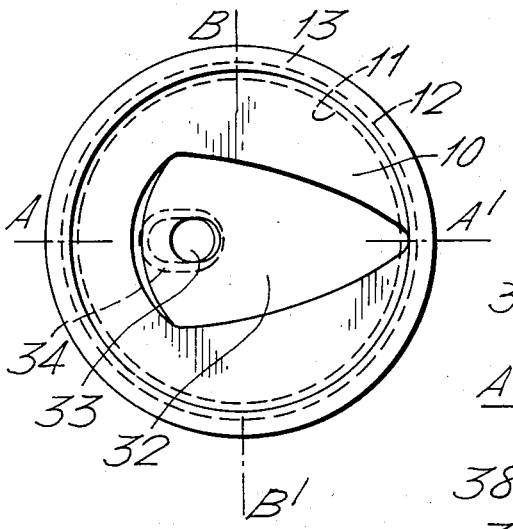
Figure 3:
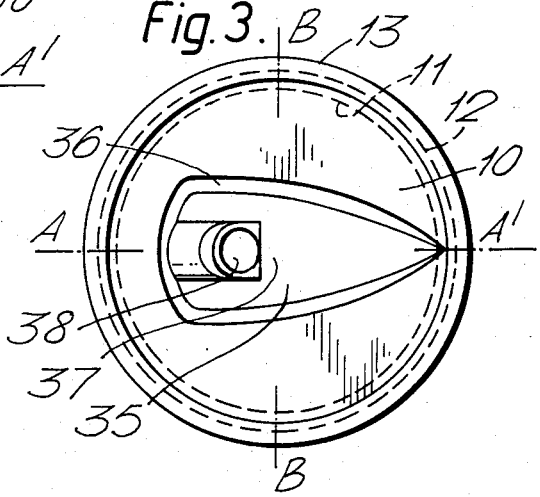
Figure 4:
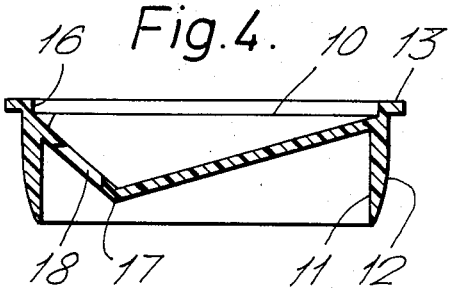
Figure 5:
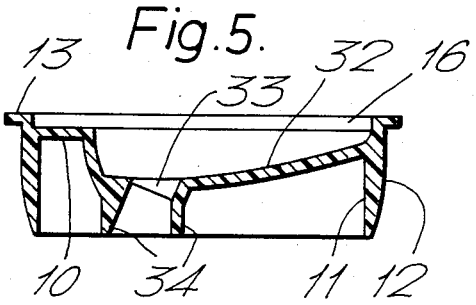
Figure 6:
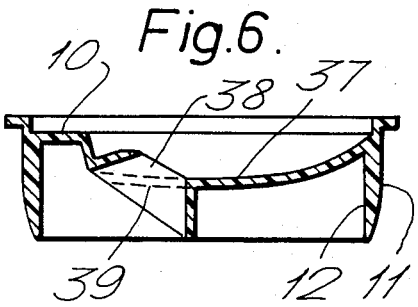

The invention will be further descried with reference to the accompanying drawings in which:

FIGS. 1, 2 and 3 are plan views from above of four inserts in accordance with the invention, FIGS. 4, 5, and 6 are, respectively, sections along the lines A—A′ of FIGS. 1, 2 and 3 and FIGS. 7, 8 and 9 are, respectively, part sections along the lines B—B′ of FIGS. 1, 2 and 3.

Referring first to FIGS. 1, 2 and 3 in general there are shown four inserts. In each embodiment a diaphragm, shown generally as (10) is rooted on a tubular plug portion, the inner and outer walls of which are shown dotted at (11) and (12) respectively. The diaphragm (10) steps into a lip (13) which is intended to overlap the neck of the bottle (not shown).

Figure 7:
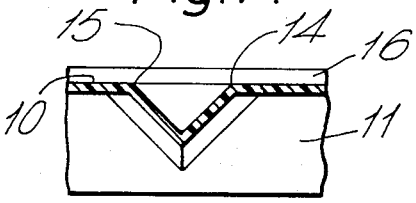

Referring now to FIGS. 1, 4 and 7, which relate to the same embodiment it can be seen from FIG. 1 that the substantially planar diaphragm (10) is interrupted by a re-entrant part (20), that is to say a part which re-enters the neck of the bottle. This re-entrant part in the embodiment shown in FIGS. 1, 4 and 7 is defined by two convergent chords (14) and (15) which meet at the step (16) which defines the circumference of the diaphragm. In more detail, as can be seen from the sections of FIGS. 4 and 7, the re-entrant part of the diaphragm is substantially tetrahedral, one face of the tetrahedron (17) being formed with a nozzle (18) the tetrahedron being elongated in the direction towards which the nozzle is angled so as to indicate to a user the direction in which a jet of liquid will be expelled.

Figure 8:
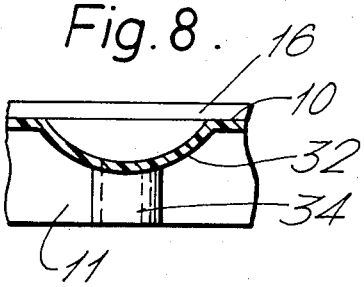

Referring now to FIGS. 2, 5 and 8 the re-entrant part of the diaphragm shown in this embodiment is shield-shaped in plan, the point of the shield meeting the circumference of the diaphragm. The floor (32) of the shield-shaped re-entrant part (35) is sloped in a gentle curve to a nozzle (33) formed in it. The lower edge of the nozzle is extended to the level of the lower edge of the plug portion of the insert in a guide tube (34). The nozzle (33) and its tube (34) are so formed in the floor the re-entrant part that they are angled towards the point of the shield.

Figure 9:
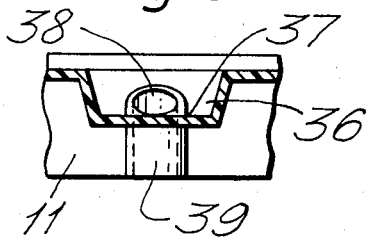

Referring finally to FIGS. 3, 6 and 9 the embodiment shown in these figures is similar to that shown in FIGS. 2, 5 and 8 except that the shield-shaped re-entrant part (35) of the diaphragm (10) is stepped via tapered step (36). The floor (37) is again formed with a nozzle (38) and a guide tube (39), but in this embodiment the guide is partly formed from the side wall of the re-entrant part.

In use, all of these embodiments are pushed into a plastics squeeze bottle containing liquid, and the user can see from the visual indication in which direction a jet of the liquid will be expressed when the bottle is squeezed. Additionally, any liquid remaining in the insert area will drain back into the bottle via the re-entrant part of the diaphragm and the nozzle. These features are important if a mildly unpleasant liquid such as a liquid bleach is to be dispensed from the bottle, since they ensure first that the liquid is not applied to areas where it is not wanted, and secondly that excess liquid does not roll down the outside of the bottle.

I claim:

1. An insert for a squeeze bottle having a bottle neck with an interior portion, said insert comprising a tubular plug portion engageable in a liquid-tight manner with said interior portion of said bottle neck and a re-entrant diaphragm disposed on said tubular plug portion, characterized in that:

(a) said diaphragm has a circumference and is substantially planar having a substantially tetrahedral re-entrant part recessed therein;

(b) said re-entrant part is formed with a nozzle angled to direct a jet of liquid at an angle of at least 20° to a vertical axis of said plug portion; and (c) said re-entrant part is defined by two convergent chords wherein said chords meet at said circumference of said diaphragm thereby indicating visually the direction in which said jet of liquid is to be directed.

* * * * *